United States Patent [19]

Kinkel

[11] Patent Number: 4,660,243

[45] Date of Patent: Apr. 28, 1987

[54] METHOD FOR ERECTING A BRIDGE SUPERSTRUCTURE OF PRESTRESSED CONCRETE AND LAUNCHING GIRDER FOR PERFORMING THE SAME

[76] Inventor: Horst Kinkel, Mozartweg 34, 6100 Darmstadt, Fed. Rep. of Germany

[21] Appl. No.: 635,798

[22] Filed: Jul. 30, 1984

[30] Foreign Application Priority Data

Aug. 11, 1983 [EP] 08111983 ..... 83 10 7978.5

[51] Int. Cl.[4] ..... E04C 3/02; E01D 1/00

[52] U.S. Cl. ..... 14/17; 14/1; 264/33; 425/63

[58] Field of Search ..... 14/2.4, 17, 73, 1; 264/33; 425/63

[56] References Cited

U.S. PATENT DOCUMENTS

| | | | |
|---|---|---|---|
| 3,003,219 | 10/1961 | Suter et al. | 264/33 |
| 3,571,835 | 3/1971 | Buechler | 264/33 X |
| 3,989,218 | 11/1976 | Muller | 264/33 X |
| 4,087,220 | 5/1978 | Koss | 264/33 X |
| 4,123,485 | 10/1978 | Tang | 14/73 X |
| 4,478,773 | 10/1984 | Büchler et al. | 264/33 X |

FOREIGN PATENT DOCUMENTS

| | | | |
|---|---|---|---|
| 2618259 | 11/1977 | Fed. Rep. of Germany | 14/17 |
| 2933061 | 2/1981 | Fed. Rep. of Germany | 14/17 |

*Primary Examiner*—Stephen J. Novosad
*Assistant Examiner*—John F. Letchford
*Attorney, Agent, or Firm*—Cahill, Sutton & Thomas

[57] ABSTRACT

A method is described for the sectional erection of a superstructure of prestressed concrete for a bridge with a launching girder carrying the formwork for the superstructure and being movable from one concreting section to the other. The process is characterized by a movement of the launching girder to the next concreting section while the previously concreted and prestressed superstructure is supported via bearings by the launching girder, which in turn is supported by the bridge supports via further bearings.

7 Claims, 7 Drawing Figures

METHOD FOR ERECTING A BRIDGE SUPERSTRUCTURE OF PRESTRESSED CONCRETE AND LAUNCHING GIRDER FOR PERFORMING THE SAME

The invention refers to a method for the segmental erection of a Bridge Superstructure of prestressed concrete by means of a launching girder carrying the formwork being movable from one concrete segment to the other.

Such method is known from IABSE Periodica (Nov.) 4, 45–68 (1981). The known method requires extremely costly and time consuming launching girders requiring hydraulic actuators for pivoting parts of the formwork downward and sideward for avoiding a collision with the piers. In view of this costly construction the launching girders must be variable in order to be adaptable to different bridge constructions.

It is a primary object of the present invention to modify the known method in such a fashion, that the use of complicated formwork launching girders with pivotable forms can be avoided.

It is a further object of the present invention to provide a formwork launching girder which does not require pivotable forms for passing the piers.

These and other objects are solved by a method for the segmental erection of a bridge superstructure of prestressed concrete with a launching girder carrying the formwork for the superstructure and being movable from one concreting segment to the other, characterized in that the launching girder is moved to the next concreting serment while the previously concreted and prestressed superstructure segment is supported via bearings by the launching girder, which in turn is supported via bearings by the support.

Such a method has enormous economical advantages. Instead of the usual costly formwork launching girder a much simpler device is used, which requires less maintenance and operation costs and less construction costs.

It is particularly advantageous to use a launching girder of prestressed concrete. Such a launching girder may be built on site by the contractor for the bridge construction. In view of this most economical method of fabricating the launching girder it may be written off for one single bridge construction.

Details of the invention shall now be described with reference to drawings.

Figure 1:
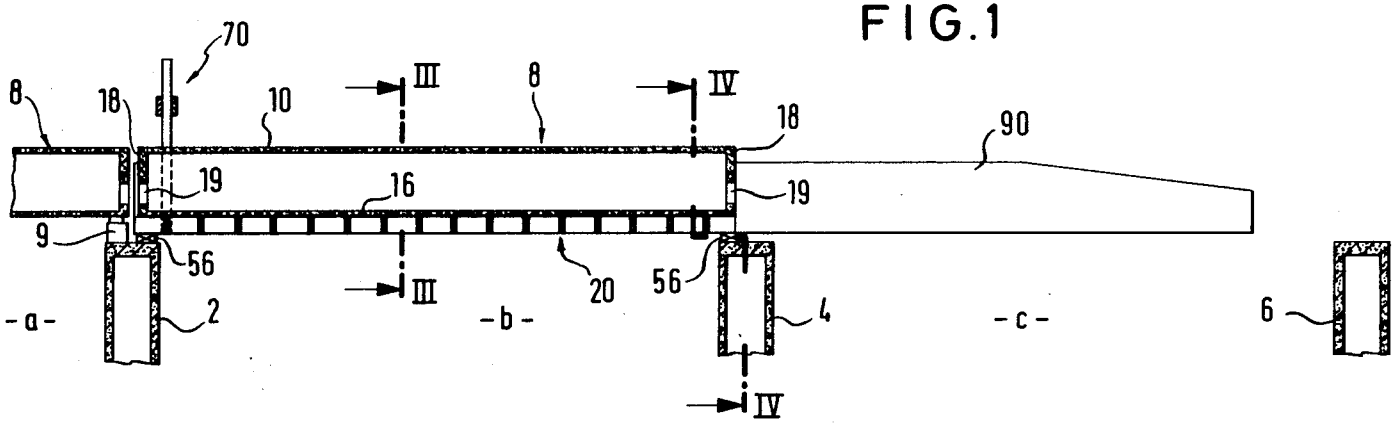
FIG. 1 shows a schematic longitudinal section, illustrating the concreting stage of the method of the invention.

FIG. 1 shows a partial range, covering three piers, 2,4, 6, of a bridge of prestressed concrete during construction. Only the upper ends of the pier are shown. On the left side of pier 2 an already finished girder 8 is shown in the first span a. It is supported in the usual manner by pier 2 through a bridge bearing (not shown in detail) and through a concrete base 9. The girder 8 is of the usual box type shown in detail in FIGS. 3 to 7. It comprises an upper slab 10 and two lateral webs 12, 14 extending vertically or at a slight angle downwardly, whereby the lower ends are connected through a transverse slab or through transverse beams 16. This bridge girder is closed at both ends by an end wall 18. The end wall has an opening 19 for the removal of the interior formwork and for rendering the interior accessible. During concreting the base 9 and during the insertion of the bridge bearing the front end of this bridge girder is supported in the usual manner on the pier 2 by means of presses. After base 9 and bridge bearing are in place these presses are removed. The invention is not limited in terms of this special type of a bridge girder and in terms of this bearing of the bridge girder. Rather, the bridge girder may also be of the type of a slab with two webs.

FIG. 1 shows a second span b between piers 2 and 4. In this span a further bridge girder is to be connected. For this purpose a launching girder 20 is used. It is preferably made of prestressed concrete. However, it may also be of a steel construction type or it may be a combination of a prestressed concrete construction and a steel construction. The launching girder corresponds to the length of one concreting segment, i.e. it extends from about the center of one pier to about the center of the other pier if the concreting segment is equal to the distance between two piers. However, the launching girder may extend over several spans if the concreting segment is longer than the distance between two piers. In the embodiment of FIG. 1 the launching girder extends from pier 2 to pier 4.

Figure 3:
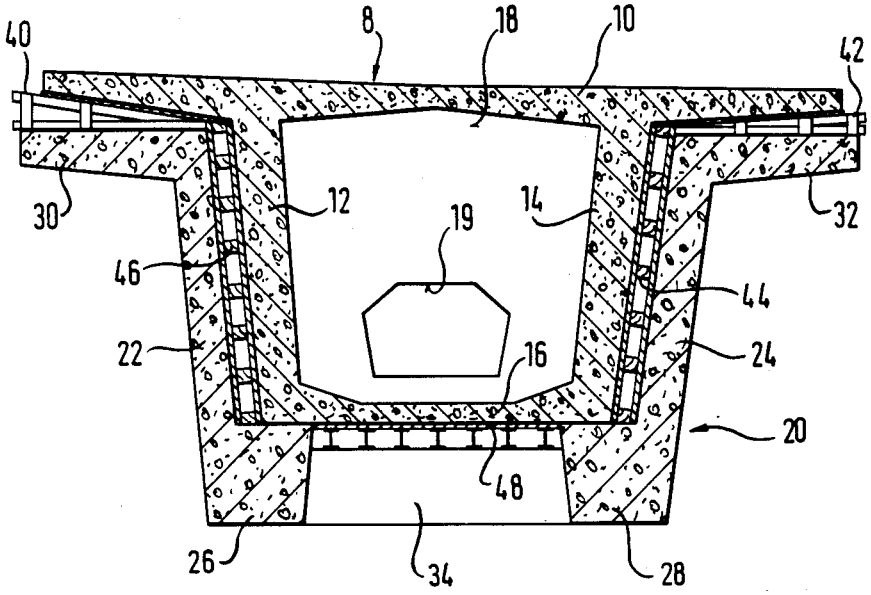
FIG. 3 shows a section along line III—III of FIG. 1 after concreting.
Figure 7:
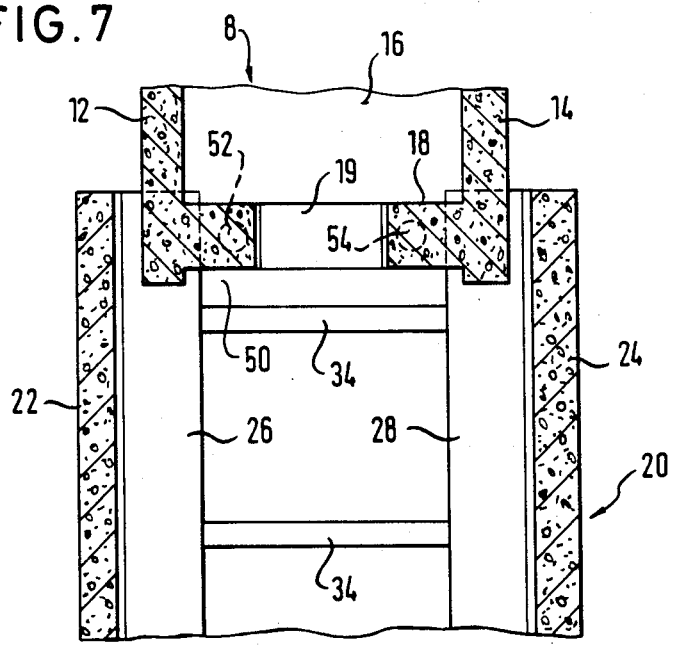
FIG. 6 shows an enlarged partial section near the middle pier of FIG. 2 during the launching stage and FIG. 7 shows a section along line VII—VII of FIG. 2.
Figure 4:
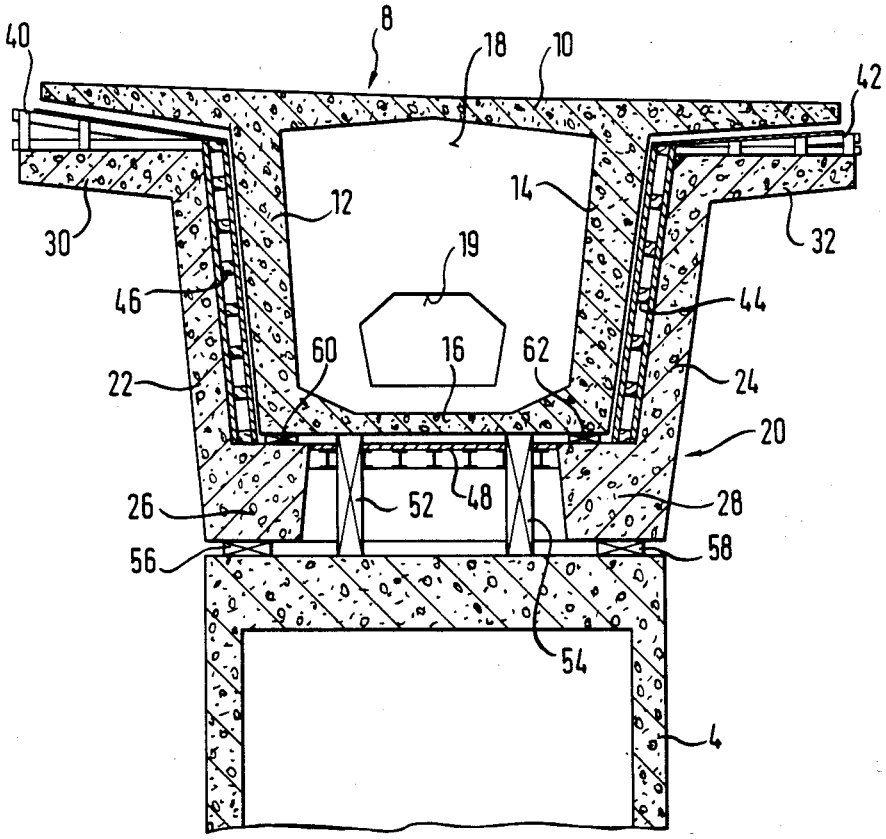
FIG. 4 shows a section along line IV—IV of FIG. 1 after the insertion of the friction bearings and prior to the removal of the auxiliary power presses.
Figure 6:
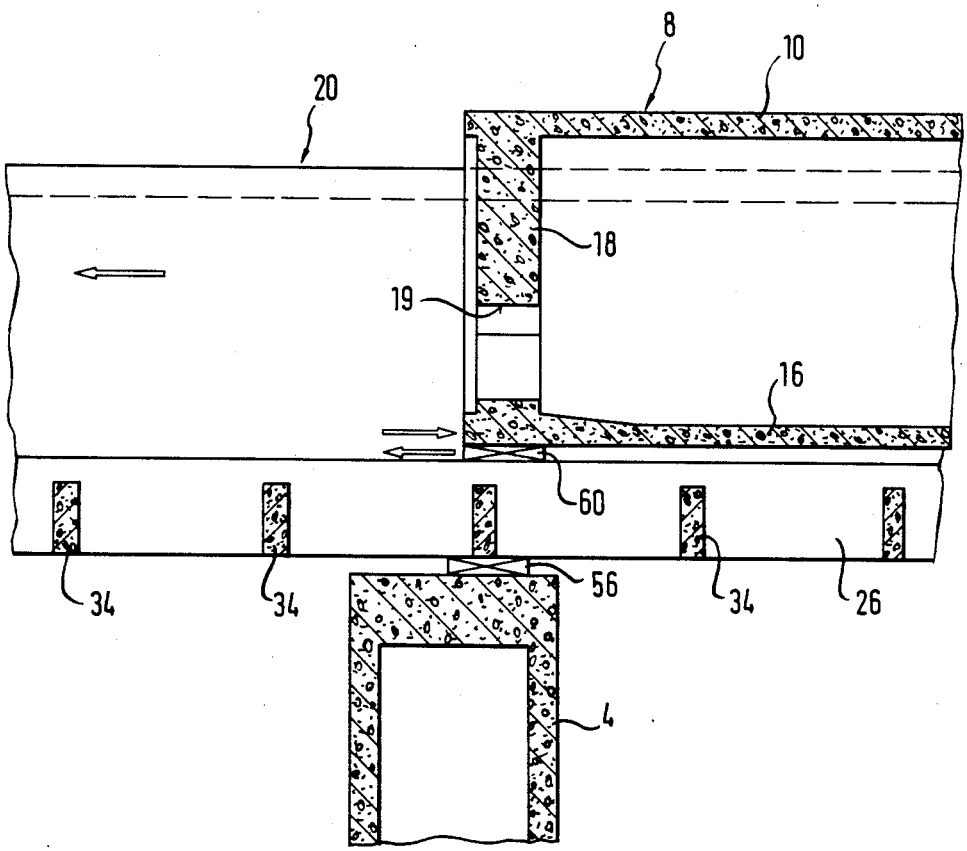

Next the general structure of the trough-shaped launching girder 20 shall be described. Reference is made to FIGS. 3,4 and 7. The trough-shaped launching girder has two lateral side walls 22, 24, which extend vertically or at a slight slant and which are of a similar shape as the sidewall of the bridge girder. The lower edge of each sidewall is connected with a longitudinal beam 26 or 28, respectively. The upper edge of each sidewall is connected with a cantilever plate 30 or 32 respectively which serves for supporting the upper slab of the bridge girder during concreting. The two longitudinal beams 26 and 28 are connected by a plurality of transverse beams 34 (FIGS. 6,7). Preferably this trough-shaped launching girder 20 is of a monolithic prestressed concrete type. It rests with its both ends on the two piers 2 and 4 through auxiliary power presses (not shown) at a height suitable for concreting the bridge girder.

FIG. 3 shows the condition after the concreting of the bridge girder 10. Wedge-shaped form elements 40,42, consisting of wood, are provided between the upper slab 10 of the bridge girder 20. Additional forms 44,46 of wood are provided between the webs 12, 14 of the bridge girder and the sidewalls 22, 24 of the launching girder. Further, a form 48 for the lower side of the bridge girder is provided which bridges the gaps between the transverse beams 34 of the launching girders. Hence, the entire launching girder is lined with form elements. Merely the area of the upper surface of the longitudinal beams 26, 28 lacks a form of wood. Instead, a separating means is provided in this area. After the launching girder has been prepared in this fashion the bridge girder is concreted in the usual manner. The bridge girder is concreted in its final position. During this operation the weight of the concreted bridge girder, the formwork and the launching girder is supported by the two piers through two pairs of power presses. The bridge girder is erected in the usual prestressed concrete construction. After solidification and after stressing the concrete this stage of construction is completed.

Next the transfer of the launching girder from span b to span c shall be described. First, the launching girder must be lowered. As shown in FIGS. 4 and 7 the two terminal transverse beams 34 are not located at the very ends of the launching girder but rather displaced by a suitable distance away from these ends. In this fashion recesses 50 are provided at both ends, which are freely accessable from both ends. In the area of these recesses 50 the bridge girder is supported directly by the piers 2, 4 i.e. without the intermediate launching girder. In the area of pier 2, the rearward end of the bridge girder is supported by the usual concrete base 9 and bridge bearing. In the area of pier 4, the forward end of the bridge girder is supported by means of two power presses 52 and 54 which extend from the upper end of pier 4 to the lower surface of the bridge girder. Now, the launching girder 20 which is supported by four auxiliary power presses (not shown) is lowered. Previously slide bearings 56, 58 have been mounted in suitable positions of pier 4. The launching girder comes to rest on these slide bearings. The rearward end of the launching girder is supported by the bridge girder through transverse frame 70 to be described later. Next slide bearings 60, 62, or lifting-friction devices that are readily commercially available (such as those manufactured and sold by Maschinenfabrik Ebersprachcr, Kirchheim, West Germany) are inserted in the area of the front end of the bridge girder 8, i.e. in the area of the pier 4 below each web 12 and 14 of the bridge girder. The bridge girder is lowered onto these friction bearings 60,62. This situation is shown in FIG. 4. Next the power presses 52, 54 are removed. In this situation the weight of the bridge girder is supported at the rearward end directly by pier 2 through concrete bases and bridge bearings and at the forward end by pier 4 through friction bearings 60, 62 (or lifting-friction-devices), the launching girder 20 and the friction bearings 56,58. Now the launching girder 20 may be moved in the longitudinal direction. It is an important advantage, that it is not necessary to build some parts of the launching girder as shuttering flaps to be pivoted downward and sideward in order to prevent a collision with pier 4. Rather, the launching girder 20 is moved between pier 4 and the bridge girder 8 in the longitudinal direction. During this movement half of the weight (the front end) of the bridge girder 8 rests via friction bearings on the launching girder.

Figure 2:
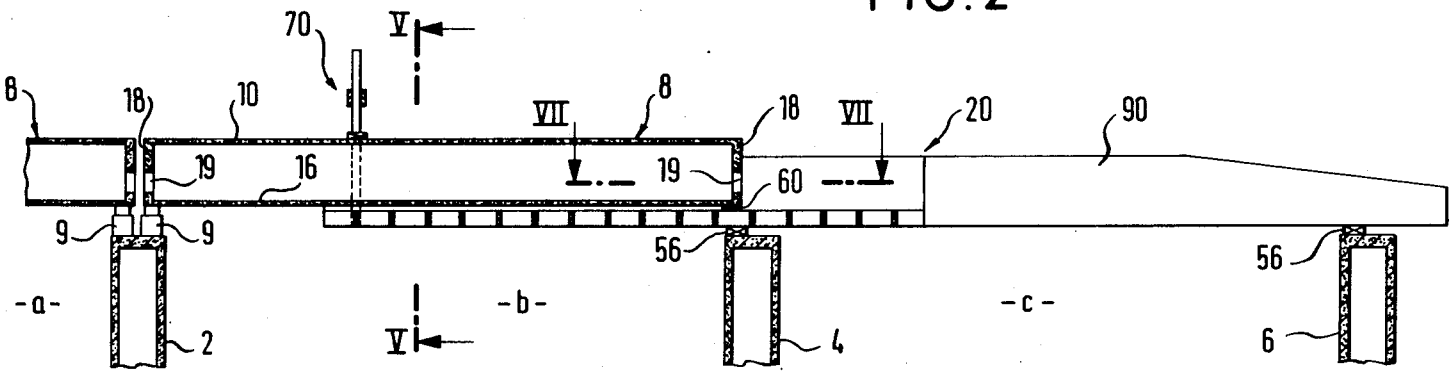
FIG. 2 shows a schematic longitudinal section illustrating the launching stage of the method of the invention.
Figure 5:
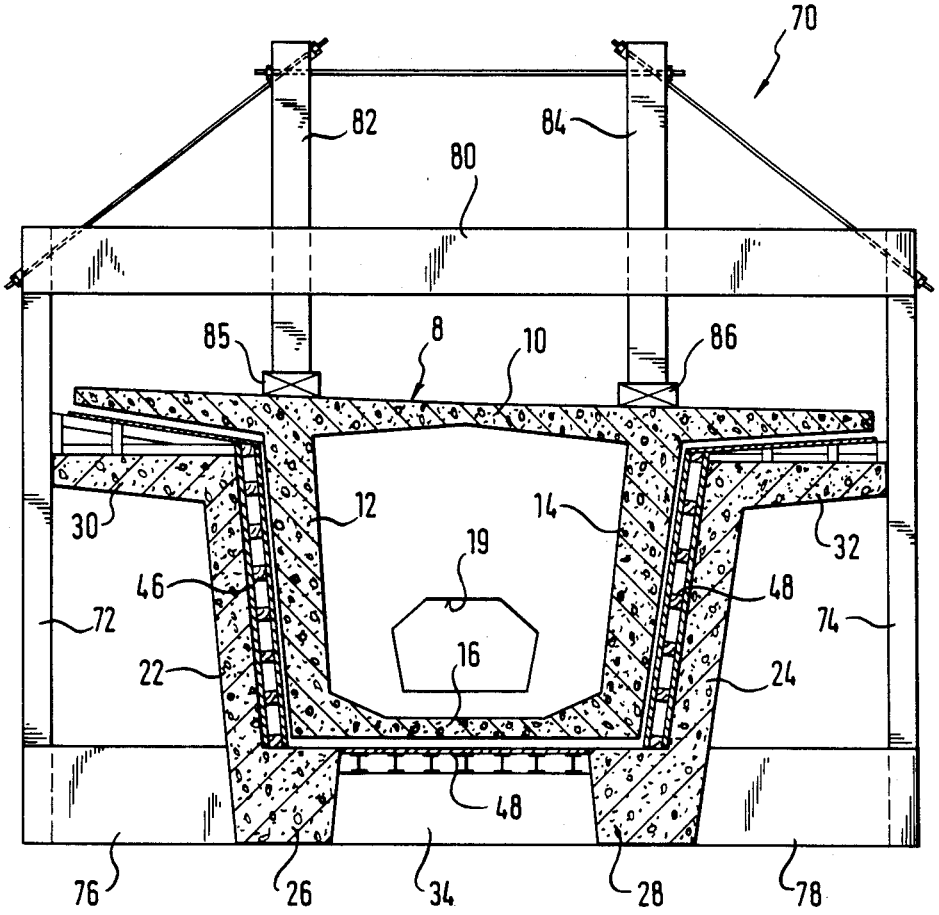
FIG. 5 shows a section along line V—V of FIG. 2.

For supporting the rearward end of the launching girder 20 during the shifting movement a transverse frame 70 is used (FIGS. 2 and 5). This transverse frame 70 is mounted at the rearward end of the launching girder. It comprises two side posts 72,74, which are attached with their middle positions to both cantilever plates 30,32 of the launching girder. The two side posts 72, 74 extend approximately vertically. Their lower ends are connected through traverses 76, 78 with the longitudinal beams 26, 28 of the launching girder. An upper traverse 80 extends between the upper ends of the side posts 72, 74. Two pillars 82, 84 are connected with this traverse 80. Their upper ends are connected with each other and with the two side posts by means of ropes, as shown in FIG. 5. Their lower end rest via friction bearings 86, 85 on the upper side of the upper slab 10 of the bridge girder. During the shifting movement of the launching girder the weight of the girder to be supported by the friction bearings 86, 85 decreases gradually. In this fashion the launching girder is shifted from span b to span c like a telescope. During this shifting movement the bridge girder is supported by pier 4 through the launching girder being shifted.

The front end of the launching girder 20 carries a usual front nose 90. After a predetermined length of movement of the launching girder this front nose 90 comes to rest on the slide bearings 56, 58 of the next pier 6. During the first phase of the shifting movement of the launching girder the entire weight of the bridge girder 8, the launching girder 20 and the front nose 90 is supported by piers 2 and 4. The weight of the launching girder and the front nose 90 are supported at one end by pier 4 and at the other end by the bridge girder 8. As soon as the front nose 90 comes to rest on the pier 6 the weight of the launching girder 20 and the front nose 90 is supported by piers 4 and 6 and by the bridge girder 8. After a further shifting movement this entire weight is supported exclusively by piers and 6.

This shifting movement is continued until the rearward end of the launching girder is located in the area of the foreward end of the bridge girder. Now the shifting movement is interrupted. Next, two power presses are inserted in the area of the rearward recess of the launching girder. These power presses assume the support of the bridge girder. Now the launching girder is shifted into the next concreting position. Next the concrete bases 9 are concreted on pier 4 and the bridge bearings are mounted. Finally the auxiliary power presses are removed. Now, the bridge girder for span c is concreted and the previously described operation is repeated.

Generally speaking the launching girder must have a supporting structure so that in the concreting stage it can support the weight of the poured concrete and the form. Further, during the shifting movement of the launching girder the weight of the bridge girder is supported by the pier through the launching girder. Therefore the launching girder must have a sufficient compression strength for tolerating the pressure exerted by the bridge girder throughout the entire length of the launching girder. Further, the launching girder must carry the form and the scaffolding for the bridge girder to be concreted. In the previously described embodiment the scaffolding consists of steel-reinforced concrete and it is an integral part of the launching girder and hence, it has an additional supporting function. Generally speaking it may be advantageous to separate the supporting function and the scaffolding function. In this case the launching girder consists of a sufficiently pressure-resistant table or slab which is connected monolithically with longitudinal girders above and/or below the slab. Two such longitudinal girders may be provided at both sides of the piers. Also additional longitudinal girders may be provided in the central area of the table or slab, which reach into recesses within the pier head. The scaffolding and form are erected in the usual manner on top of this table or slab. The table or slab of the launching girder must have a sufficient compression strength, at least along the track of the slide bearings. This can be achieved simply by the use of a steel-reinforced concrete slab or by a steel table, filled with concrete or by a steel girder with a sufficient number of closely spaced transverse webs.

In some cases the lowering of the launching girder may not provide a sufficient distance between the interior surfaces of the launching girder and the outer surfaces of the superstructure. In such cases the form elements in the area of the sidewalls of the trough-shaped launching girder may be retractable. In the concreting position they have a greater distance from the trough sidewalls than in the launching condition. Before stressing the most recently concreted bridge girder the form elements are retracted. For this purpose bolts are provided, which extend from the form elements through corresponding through holes in the launching girder sidewalls toward the outside, where they may be easily manipulated.

In a preferred embodiment the driving device rests against the previously concreted bridge girder while it engages the launching girder in launching direction. Alternatively the driving device may be anchored at the pier, whereby the launching is pulled forward. In a most preferred embodiment a lifting-friction-apparatus is used as the driving device. It is inserted between the superstructure and the launching girder. Such a lifting-friction-apparatus may be used in place of the friction bearing between the superstructure and the launching girder in the area of the piers. However, it may also be positioned in the area of the transverse frame between the superstructure and the launching girder.

The concreting segment may be a one-span girder or it may be a part of a continuous bridge girder. The concreting segment may extend from one pier to the next or it may extend from a point between two piers to a corresponding point in the next span.

Preferably the bearings 56, 58, 60, 62, 85 and 86 are slide bearings or friction bearings with the usual bearing materials, for example stainless steel and polytetrafluoroethylene. It is of course also possible to use bearings with a plurality of rollers. Further, as previously mentioned, a combination of a launching device and a bearing device, such as a lifting-friction-apparatus may be used. In the previously described embodiments, the bearings 60, 62 are inserted after concreting. In an alternative embodiment, the upper surfaces of the longitudinal beams 26, 28 may carry a form and the bearings 50, 62 may already be put in position as a part of this form prior to concreting.

In the previously described embodiments the rearward end of the launching girder rests on the previously concreted bridge girder segment via a transverse frame during the launching and/or during concreting. It is also possible to eliminate the transverse frame and to provide the launching girder instead with rearward extensions, which are supported on both sides of the pier by means of auxiliary supports, via bearings.

I claim:

1. A launching girder for the segmented erection of a prestressed concrete bridge superstructure, said girder being formed of monolithic prestressed concrete and comprising a longitudinally extending trough-shaped member having opposing side walls each terminating at an upper edge thereof in a cantilever plate and terminating at a lower edge thereof in a longitudinally extending beam, and a plurality of transverse beams extending between said longitudinally extending beams.

2. A method for the segmental erection of a prestressed concrete superstructure of a bridge having a plurality of bridge supports comprising:

(a) positioning a formwork carrying launching girder between first and second bridge supports;

(b) concreting and stressing a superstructure segment by using said formwork; and (c) supporting said superstructure through bearings contacting said launching girder while launching said girder to an adjacent position between said second bridge support and a third bridge support while supporting said launching girder through bearings contacting said second bridge support.

3. The method of claim 2 including the step of supporting said superstructure by power presses while the launching girder is lowered to provide a space between the launching girder and the superstructure, inserting bearings in said space, and removing said power presses.

4. The method of claims 2 or 3 characterized in that a launching device is used to launch said girder and wherein said device rests against the concreted superstructure segment while it pushes the launching girder to a next concreting position.

5. The method of claims 2 or 3 characterized in that a launching device is used to launch said girder and wherein said device is anchored at a bridge support while it pulls the launching girder to a next concreting position.

6. The method of claims 2 or 3 characterized in that a lifting-friction-device is inserted as a launching device between the superstructure and the launching girder.

7. The method of claims 2 or 3 characterized in that shortly before an adjacent position is reached the launching movement is interrupted and power presses are inserted to support the weight of the superstructure.

* * * * *